US007992529B2

(12) United States Patent
Kobayashi et al.

(10) Patent No.: US 7,992,529 B2
(45) Date of Patent: Aug. 9, 2011

(54) INTERNAL COMBUSTION ENGINE

(75) Inventors: Makoto Kobayashi, Fujisawa (JP); Kenshi Ushijima, Kamakura (JP); Naoki Takahashi, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 546 days.

(21) Appl. No.: 12/188,434

(22) Filed: Aug. 8, 2008

(65) Prior Publication Data

US 2009/0044782 A1 Feb. 19, 2009

(30) Foreign Application Priority Data

Aug. 13, 2007 (JP) ..... 2007-210803

(51) Int. Cl.
*F02B 75/04* (2006.01)
*F02B 75/32* (2006.01)

(52) U.S. Cl. ..... 123/48 B; 123/197.4; 123/78 F

(58) Field of Classification Search ..... 123/197.1, 123/197.4, 48 R, 48 B, 78 R, 78 F
See application file for complete search history.

(56) References Cited

FOREIGN PATENT DOCUMENTS

JP 2001-317383 A 11/2001

*Primary Examiner* — Noah Kamen
(74) *Attorney, Agent, or Firm* — Foley & Lardner LLP

(57) ABSTRACT

In an internal combustion engine, comprising: an upper link (11) connected via a piston pin (21) to a piston (32) that reciprocates within a cylinder; a lower link (12) attached to a crank pin (33*b*) of a crankshaft (33) to be free to rotate and connected to the upper link (11) via an upper pin (22); and a control link (13) which is connected to the lower link (12) via a control pin (23) and oscillates about an oscillation central shaft (24), the following equation is established when the piston (32) is at bottom dead center $$\cos(\theta_l+\alpha)<\cos(\theta_l+\pi)$$

where:
$\theta_l$ is a lower link attitude angle; and
$\alpha$ is a lower link aperture angle.
As a result, a load acting on a crank journal when the piston is at bottom dead center can be reduced.

9 Claims, 9 Drawing Sheets

LINK ATTITUDE AT PISTON
BOTTOM DEAD CENTER

LINK ATTITUDE AT PISTON
TOP DEAD CENTER

WHEN A LENGTH $R_3$ OF AN ARM IS GREAT AND $R_6$ IS SMALLER,
THE LOAD INCREASE IS SMALL
$R_3 = L_2 \sin \theta_2$
$R_6 = L_4 \sin \theta_4$
IT IS DIFFICULT TO ACHIEVE A REDUCTION IN THE LOAD INCREASE AT TOP DEAD CENTER, BUT IN ORDER TO SUPPRESS THE LOAD ON THE TOP DEAD CENTER SIDE, $\sin \theta_2$ IS PREFERABLY MADE LARGE AND $\sin \theta_4$ IS PREFERABLY MADE SMALL

INTERNAL COMBUSTION ENGINE

FIELD OF THE INVENTION

This invention relates to an internal combustion engine.

BACKGROUND OF THE INVENTION

JP2001-317383A, published by the Japan Patent Office in 2001, discloses a multi-link internal combustion engine in which a piston and a crankshaft are connected by a plurality of links, i.e. an upper link and a lower link.

SUMMARY OF THE INVENTION

In this type of multi-link internal combustion engine, a load acting on a crank journal at piston bottom dead center is large. In a serial four-cylinder multi-link internal combustion engine, the load acting on a third crank journal when a second cylinder piston and a third cylinder piston are at bottom dead center is particularly large. The reason for this will now be explained.

As shown in FIG. 9, a third crank journal 33*a*-3 of a serial four-cylinder engine exists between the second cylinder and the third cylinder.

When the second cylinder piston and third cylinder piston are located directly before top dead center, one of the cylinders is ignited such that combustion pressure begins to act on the piston of this cylinder. The pistons then reach top dead center and start to descend. The combustion pressure that acts thus on the piston acts in an opposite direction to an inertial force by which the second cylinder piston and third cylinder piston attempt to ascend, and therefore a load acting on the third crank journal 33*a*-3 is small.

In contrast, when the second cylinder piston and third cylinder piston are at bottom dead center, all of the inertial force by which the second cylinder piston and third cylinder piston attempt to descend acts on the third crank journal 33*a*-3, whereupon the pistons start to ascend. Hence, the load acting on the third crank journal 33*a*-3 is large.

Referring to FIG. 8A, piston position variation relative to crank angle variation will be described.

A broken line in FIG. 8A shows an internal combustion in which the piston and the crankshaft are connected by a single link, i.e. a connecting rod. This is a typical internal combustion engine, but will be referred to hereafter as a "single link internal combustion engine" to differentiate it from a multi-link internal combustion engine.

A solid line in FIG. 8A shows a multi-link internal combustion engine. In a multi-link internal combustion engine, a piston stroke can be adjusted by adjusting the links. Therefore, the solid line in FIG. 8A shows the piston stroke of the multi-link internal combustion engine when top dead center and bottom dead center have been adjusted to match the single link internal combustion engine shown by the broken line in FIG. 8A.

In the vicinity of top dead center, piston position variation in relation to identical crank angle variation is smaller in the multi-link internal combustion engine than in the single link internal combustion engine. In the vicinity of bottom dead center, the multi-link internal combustion engine exhibits greater piston position variation than the single link internal combustion engine.

With this characteristic, piston stroke acceleration corresponding to the crank angle is as shown in FIG. 8B.

It is evident from the piston stroke acceleration at an identical crank angle that in the vicinity of top dead center, the piston stroke acceleration of the multi-link internal combustion engine is smaller than the piston stroke acceleration of the single link internal combustion engine. In the vicinity of bottom dead center, the piston stroke acceleration of the multi-link internal combustion engine is greater than the piston stroke acceleration of the single link internal combustion engine.

A multi-link internal combustion engine has a larger number of constitutional components and a greater inertial mass than a single link internal combustion engine. Moreover, as shown in FIG. 8B, the piston stroke acceleration in the vicinity of bottom dead center is greater in a multi-link internal combustion engine, and therefore the inertial force by which the second cylinder piston and third cylinder piston attempt to descend increases. Due to the action of this large inertial force, the load acting on the third crank journal 33*a*-3 is large.

When the load acting on the third crank journal 33*a*-3 is large, a bearing cap must be fastened tightly to the cylinder block so that the load can be resisted. As a result, a fastening bolt and the bearing cap increase in size.

It is therefore an object of this invention to set a link geometry such that a load acting on a crank journal when a piston is at bottom dead center decreases.

In order to achieve the above object, this invention provides a link geometry of an internal combustion engine which comprises an upper link connected via a piston pin to a piston that reciprocates within a cylinder, a lower link attached to a crank pin of a crankshaft to be free to rotate and connected to the upper link via an upper pin, and a control link which is connected to the lower link via a control pin and oscillates about an oscillation central shaft, wherein a following equation is established when the piston is at bottom dead center $$\cos(\theta_l+\alpha)<\cos(\theta_l+\pi)$$

where:

$\theta_l$ is a lower link attitude angle formed by a line connecting the control pin and the crank pin and a line perpendicular to the upper link and passing through the crank pin; and $\alpha$ is a lower link aperture angle formed by the line connecting the control pin and the crank pin and a line connecting the crank pin and the upper pin.

This invention also provides a link geometry of an internal combustion engine which comprises an upper link connected via a piston pin to a piston that reciprocates within a cylinder, a lower link attached to a crank pin of a crankshaft to be free to rotate and connected to the upper link via an upper pin, and a control link which is connected to the lower link via a control pin and oscillates about an oscillation central shaft, wherein, at a timing when a piston acceleration reaches a maximum, a following equation is established $$\cos(\theta_l+\alpha)<\cos(\theta_l+\pi)$$

where:

$\theta_l$ is a lower link attitude angle formed by a line connecting the control pin and the crank pin and a line perpendicular to the upper link and passing through the crank pin; and $\alpha$ is a lower link aperture angle formed by the line connecting the control pin and the crank pin and a line connecting the crank pin and the upper pin.

The details as well as other features and advantages of this invention are set forth in the remainder of the specification and are shown in the accompanying drawings.

DESCRIPTION OF THE PREFERRED EMBODIMENTS

Figure 1:
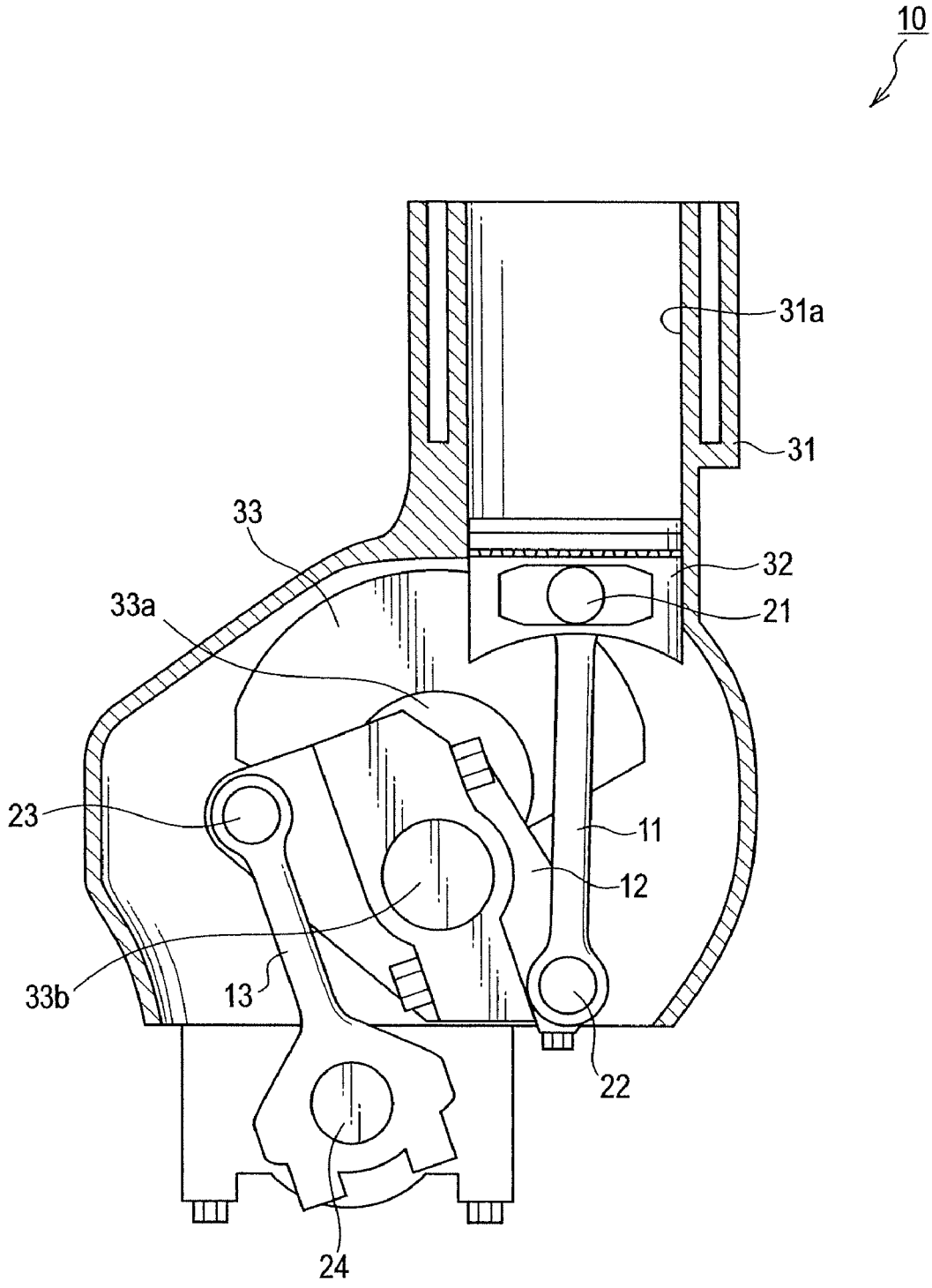
FIG. 1 is a schematic constitutional diagram of a multi-link internal combustion engine according to this invention.

Referring to FIG. 1 of the drawings, in a multi-link internal combustion engine 10, a piston 32 and a crankshaft 33 are connected by a plurality of links, an upper link 11 and a lower link 12. Further, a control link 13 is connected to the lower link 12.

An upper end of the upper link 11 is connected to the piston 32 via a piston pin 21. The piston 32 reciprocates within a cylinder 31*a* of a cylinder block 31 after receiving combustion pressure. A lower end of the upper link 11 is connected to one end of the lower link 12 via an upper pin 22.

One end of the lower link 12 is connected to the upper link 11 via the upper pin 22. Another end of the lower link 12 is connected to the control link 13 via a control pin 23. A crank pin 33*b* of the crankshaft 33 is inserted into a connecting hole in the center of the lower link 12. The crankshaft 33 includes a plurality of crank journals 33*a* and crank pins 33*b*. The crank journal 33*a* is supported rotatably on the cylinder block by a bearing cap. The crank pin 33*b* is eccentric to the crank journal 33*a* by a predetermined amount, and the lower link 12 is attached thereto. The lower link 12 rotates with the crank pin 33*b* as a central axis.

A tip end of the control link 13 is connected to the lower link 12 via the control pin 23. Another end of the control link 13 is connected to the cylinder block 31 via an oscillation central shaft 24. The control link 13 oscillates about the oscillation central shaft 24.

As described above, in a serial four-cylinder multi-link internal combustion engine, a load acting on a third crank journal when a second cylinder piston and a third cylinder piston are at bottom dead center is large.

Therefore, in this invention, the geometry is set such that when these pistons are at bottom dead center, the load acting on the crank journal decreases.

Figure 2:
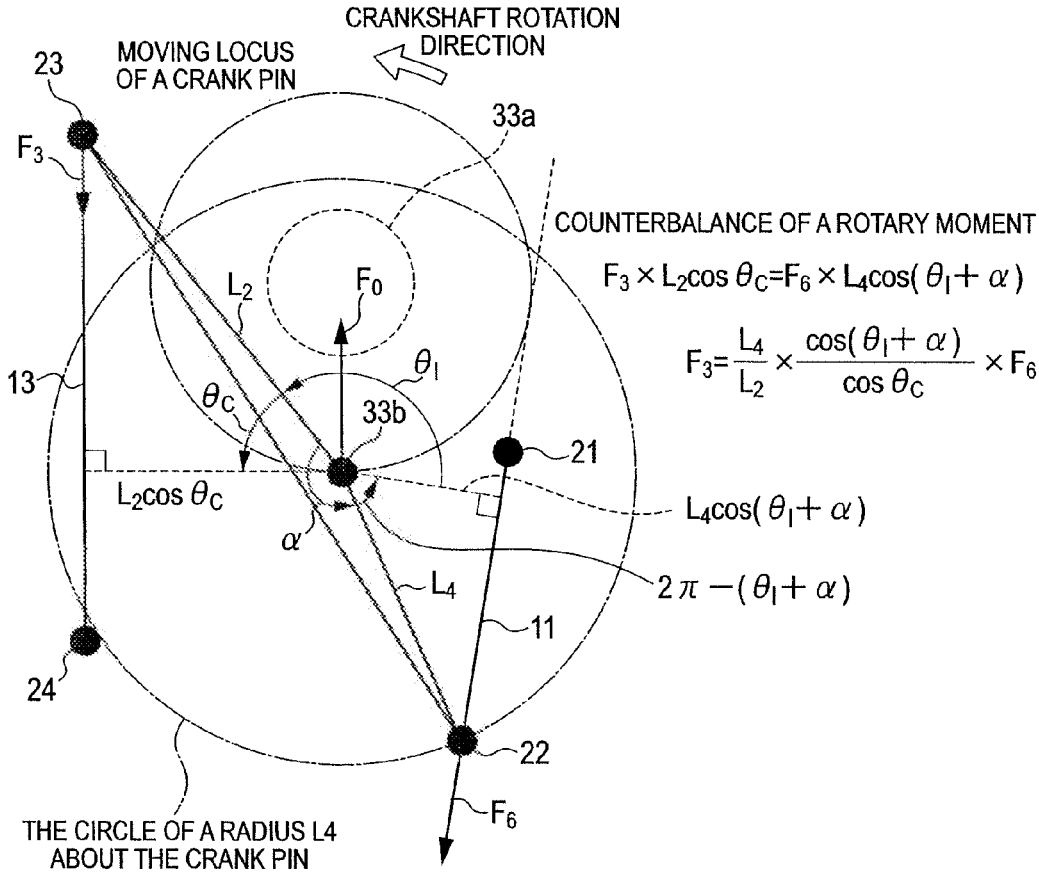
FIG. 2 is a diagram illustrating a load that acts on a lower link of the multi-link internal combustion engine.

Referring to FIG. 2, a load that acts on the lower link will be described.

A crank pin load $F_0$ acts on the crank pin 33*b*. A control pin load $F_3$ acts on the control pin 23. An upper pin load $F_6$ is applied to the upper pin 22 from the piston 32.

The crank pin load $F_0$, the control pin load $F_3$, and the upper pin load $F_6$ are related as shown in the following Equation (1).

$$\vec{F_0}+\vec{F_3}+\vec{F_6}=0 \tag{1}$$

Taking into account the counterbalance of a rotary moment of the control pin load $F_3$ and the upper pin load $F_6$ about the crank pin 33*b*, the following Equation (2) is established.

$$F_3 \times L_2 \cos\theta_c = F_6 \times L_4 \cos(\theta_l+\alpha) \tag{2}$$

where:

$L_2$ is an inter-axial distance from the crank pin 33*b* to the control pin 23;

$L_4$ is an inter-axial distance from the crank pin 33*b* to the upper pin 22;

$\theta_c$ is an angle formed by a line connecting the control pin 23 and the crank pin 33*b* and a line perpendicular to the control link 13 and passing through the crank pin 33*b*;

$\theta_l$ is a lower link attitude angle formed by the line connecting the control pin 23 and the crank pin 33*b* and a line perpendicular to the upper link 11 and passing through the crank pin 33*b*; and α is a lower link aperture angle formed by the line connecting the control pin 23 and the crank pin 33*b* and a line connecting the crank pin 33*b* and the upper pin 22.

When Equation (2) is transformed, the following Equation (3) is obtained.

$$F_3 = \frac{L_4}{L_2} \times \frac{\cos(\theta_l+\alpha)}{\cos\theta_c} \times F_6 \tag{3}$$

The upper pin load $F_6$ is determined by the combustion pressure and so on, and therefore cannot be adjusted. Furthermore, as $L_4/L_2$ increases, a piston stroke amount relative to a crankshaft radius increases. In other words, the stroke length can be increased. To put it another way, to increase the stroke length of the piston stroke, $L_4/L_2$ must be increased. However, when $L_4/L_2$ increases, the control pin load $F_3$ increases, as shown in Equation (3). As a result, the crank pin load $F_0$ increases, leading to an increase in the load acting on the crank journal, as is evident from Equation (1).

Hence, in this invention, the geometry is set such that at piston bottom dead center, $\cos(\theta_l+\alpha)$ is as small as possible. With this geometry, the control pin load $F_3$ decreases, the crank pin load $F_0$ decreases, and the load acting on the crank journal increases.

Here, a ratio $F_0/F_6$ of the crank pin load $F_0$ to the upper pin load $F_6$ is defined as a load increase rate. In this invention, the upper link 11 and the control link 13 are substantially parallel at piston bottom dead center. In other words, a line connecting the piston pin 21 and the upper pin 22 and a line connecting the control pin 23 and the oscillation central shaft 24 are substantially parallel. Thus, the direction of the crank pin load $F_3$ and the direction of the upper pin load $F_6$ are substantially identical. Accordingly, the sum of the magnitude of a vector $F_3$ and the magnitude of a vector $F_6$ equals the sum of the vector $F_3$ and the vector $F_6$. Thus, a relationship shown in the following Equation (4) is established.

$$\frac{|\vec{F_0}|}{|\vec{F_6}|} = \frac{|\vec{F_3}+\vec{F_6}|}{|\vec{F_6}|} \cong \frac{|\vec{F_3}|}{|\vec{F_6}|} + 1 \tag{4}$$

Taking Equation (3) into account, the load increase rate is expressed by the following Equation (5).

$$\frac{|\vec{F_0}|}{|\vec{F_6}|} \cong \frac{|\vec{F_3}|}{|\vec{F_6}|} + 1 \cong \frac{L_4}{L_2} \times \frac{\cos(\theta_l+\alpha)}{\cos\theta_c} + 1 \tag{5}$$

Figure 3:
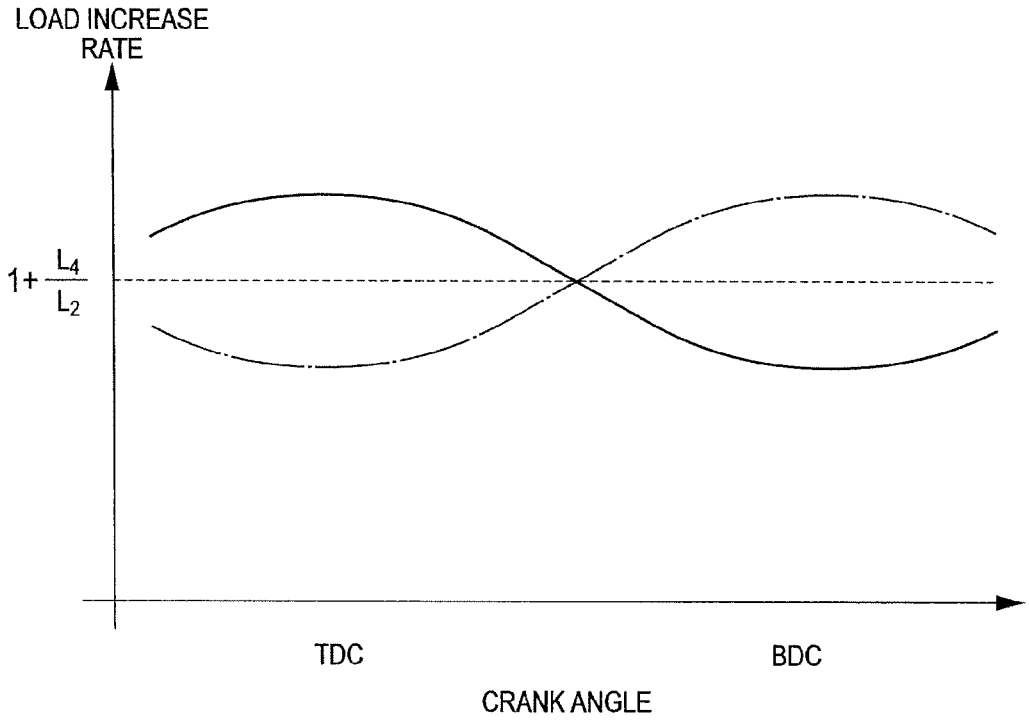
FIG. 3 is a diagram illustrating the load that acts on the lower link.
Figure 4:
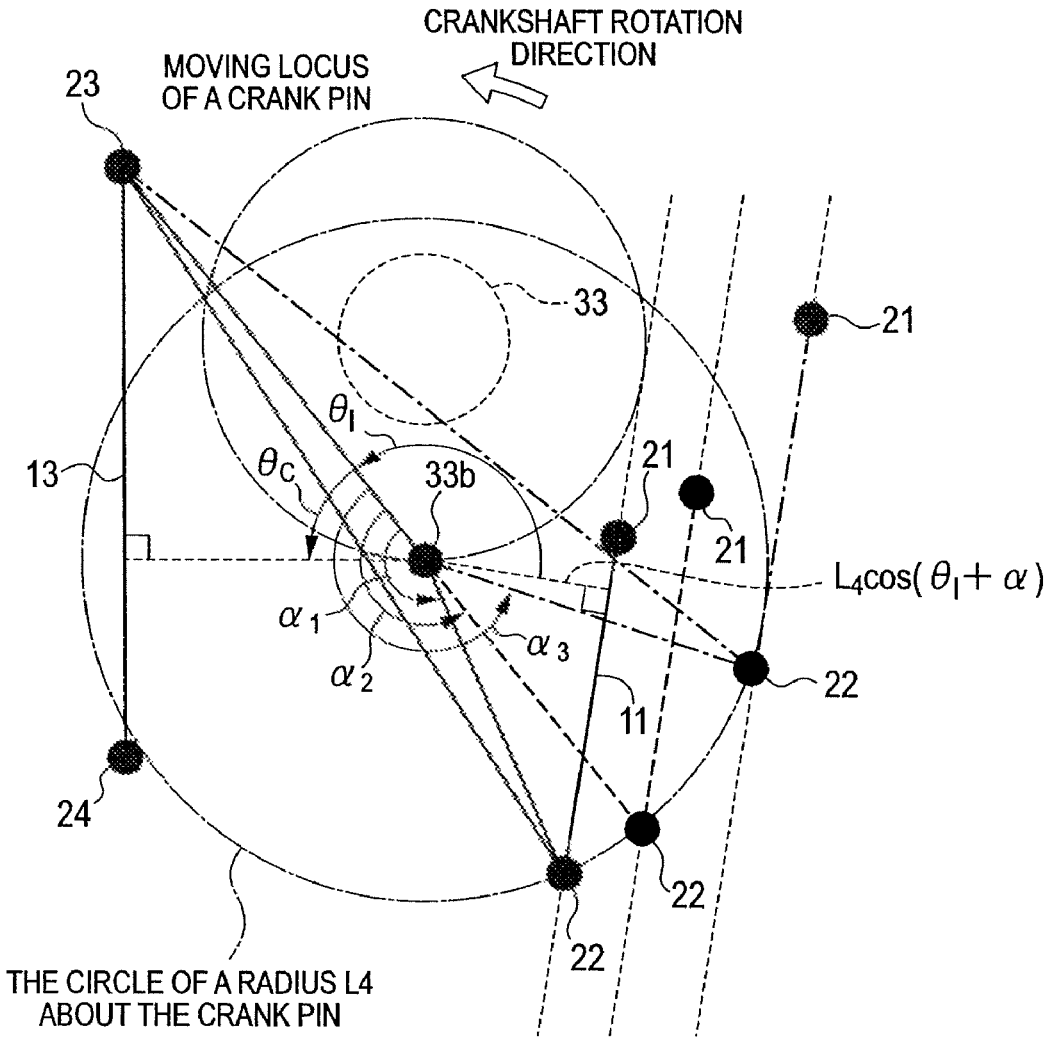
FIG. 4 is a diagram illustrating a relationship between a lower link aperture angle α and the geometry of the lower link.

Referring to FIGS. 3 and 4, a load that acts on the lower link in accordance with the lower link aperture angle will α be described.

A characteristic shown in FIG. 3 exists between the crank angle and the load increase rate.

As shown by a broken line in FIG. 4, when the lower link aperture angle $\alpha$ is set to equal $\pi$ (rad), the load increase rate becomes constant regardless of the crank angle, as shown by a broken line in FIG. 3.

As shown by a dot-dash line in FIG. 4, when the lower link aperture angle $\alpha$ is set such that a distance $L_4 \times \cos(\theta_l+\alpha)$ from the crank pin 33*b* to the upper link 11 becomes larger than $L_4 \times \cos(\theta_l+\pi)$, the load increase rate decreases at piston top dead center and increases at piston bottom dead center, as shown by a dot-dash line in FIG. 3.

As shown by a solid line in FIG. 4, when the lower link aperture angle $\alpha$ is set such that the distance $L_4 \times \cos(\theta_l+\alpha)$ from the crank pin 33*b* to the upper link 11 becomes smaller than $L_4 \times \cos(\theta_l+\pi)$, the load increase rate increases at piston top dead center and decreases at piston bottom dead center, as shown by a solid line in FIG. 3.

To reduce the load acting on the crank journal when the piston is at bottom dead center, the load increase rate preferably varies as shown by the solid line in FIG. 3. Therefore, in this invention, the lower link attitude angle $\theta_l$ and the lower link aperture angle $\alpha$ are set such that when the piston is at bottom dead center, $\cos(\theta_l+\alpha)$ becomes smaller than $\cos(\theta_l+\pi)$. In so doing, the crank pin load $F_0$ decreases at piston bottom dead center, enabling a reduction in the load acting on the crank journal.

It should be noted that the crank pin load $F_0$ becomes excessively large at a timing when the piston acceleration reaches a maximum. Therefore, it is particularly preferable to set the lower link attitude angle $\theta_l$ and the lower link aperture angle $\alpha$ such that at the timing when the piston acceleration reaches a maximum, $\cos(\theta_l+\alpha)$ becomes smaller than $\cos(\theta_l+\pi)$.

Figure 5:
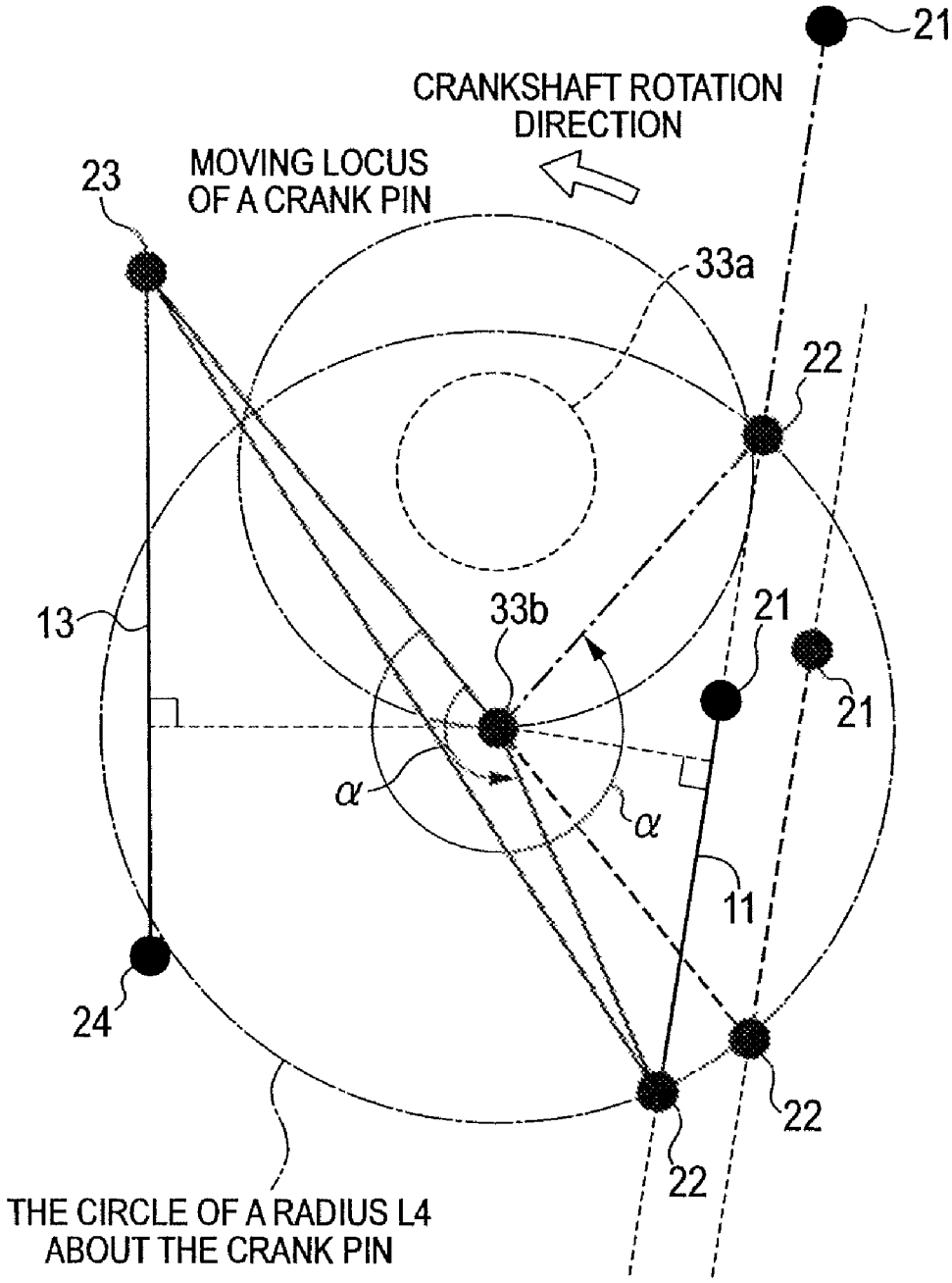
FIG. 5 is another diagram illustrating the relationship between the lower link aperture angle α and the geometry of the lower link.

Furthermore, $\cos(\theta_l+\alpha)$ not only becomes smaller than $\cos(\theta_l+\pi)$ when the lower link aperture angle $\alpha$ is smaller than $\pi$. As shown by a dot-dash line in FIG. 5, $\cos(\theta_l+\alpha)$ also becomes smaller than $\cos(\theta_l+\pi)$ when the lower link aperture angle $\alpha$ is larger than $\pi$. As a result, the lower link 12 decreases in size. However, when the lower link aperture angle $\alpha$ is smaller than $\pi$, the position of the piston pin 21 lowers, as shown by a solid line in FIG. 5, and as a result, the overall height of the engine decreases. Design should be performed appropriately, taking into account both of these characteristics.

Figure 6A:
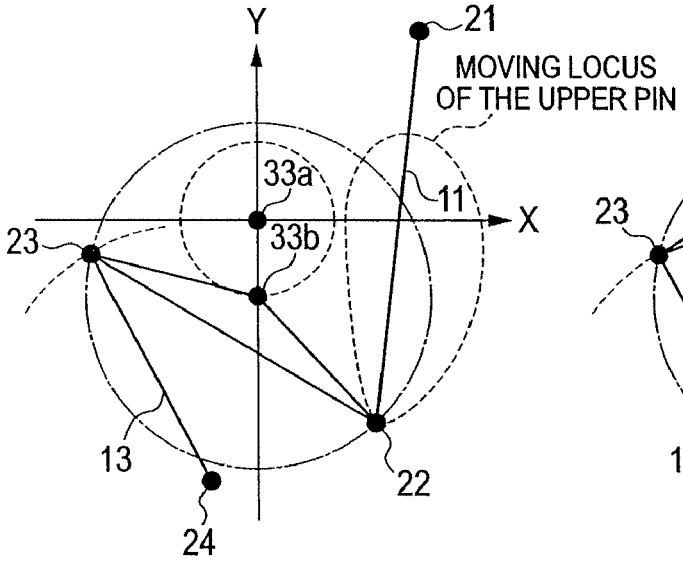
FIGS. 6A and 6B are diagrams illustrating a moving locus of an upper pin when the lower link aperture angle α is smaller than π.
Figure 6B:
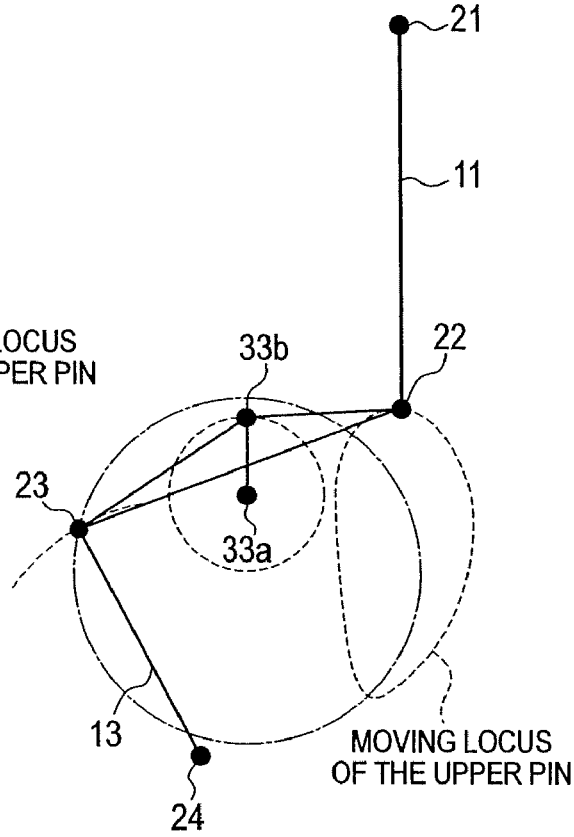

Further, when the lower link aperture angle $\alpha$ is smaller than $\pi$, a moving locus of the upper pin is as shown in FIGS. 6A and 6B. When a direction in which a line segment linking any two points on an elliptical locus has a maximum length is thus substantially identical to the piston stroke direction, the piston stroke is increased in length.

Further, when an axis that has the crank journal 33*a* as an origin, is parallel to the piston stroke direction, and has an engine upper portion direction as a positive is set as a Y axis, and an axis rotated −90° relative to the Y axis in the crank rotation direction is set as an X axis, as shown in FIG. 6A, the oscillation central shaft 24 is preferably disposed in the region of a third quadrant (X<0 and Y<0). In so doing, a stroke direction secondary oscillation component of the piston acceleration decreases, whereby engine secondary oscillation accompanying lengthening of the piston stroke is reduced.

Further, when the rotation radius of the crank pin is set at $R_0$ and a value of half the width of the upper link 11 is set at $D_4$, the lower link aperture angle $\alpha$ is preferably set within a range that satisfies the following Equation (6).

$$\cos(\theta_l+\alpha) > \frac{R_0+D_4}{L_4} \tag{6}$$

In so doing, interference between the crank pin 33*b* and the upper link 11 can be avoided at piston bottom dead center, without increasing an upper link tilt angle relative to a bore center line, and as a result, piston side thrust in the vicinity of bottom dead center can be reduced. Hence, when the invention is applied to an engine in which a lower end of a piston skirt moves below a lower end of a cylinder bore, a particularly large reduction in the piston side thrust can be achieved, and as a result, the durability of the piston is improved.

Figure 7:
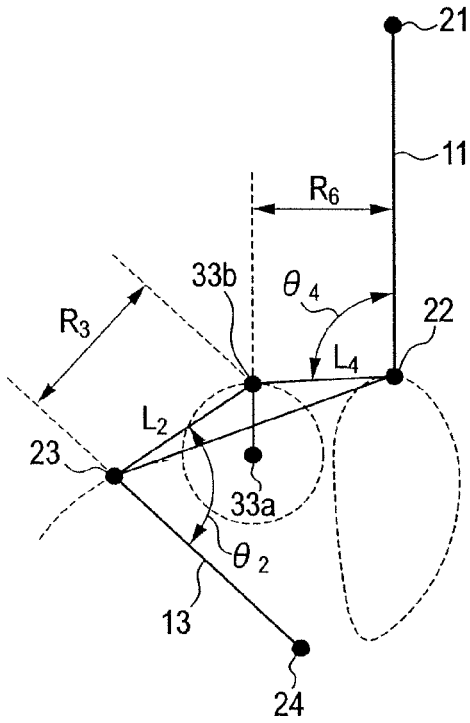
FIG. 7 is a diagram illustrating the geometry of the lower link when a piston is at top dead center.
Figure 8A:
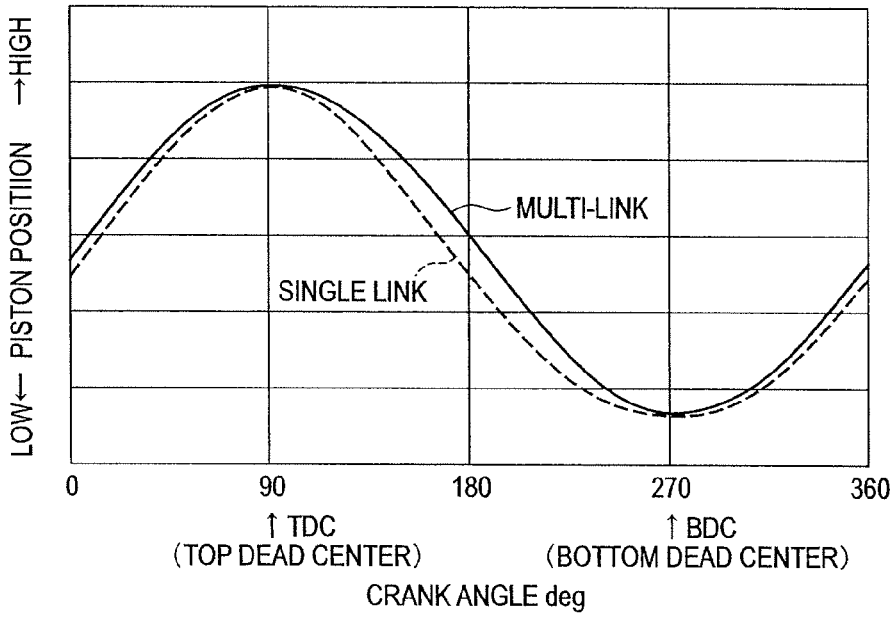
PRIOR ART FIG.8A
FIGS. 8A and 8B are timing charts illustrating a piston stroke characteristic relative to a crank angle in a conventional multi-link internal combustion engine and a single link internal combustion engine.
Figure 8B:
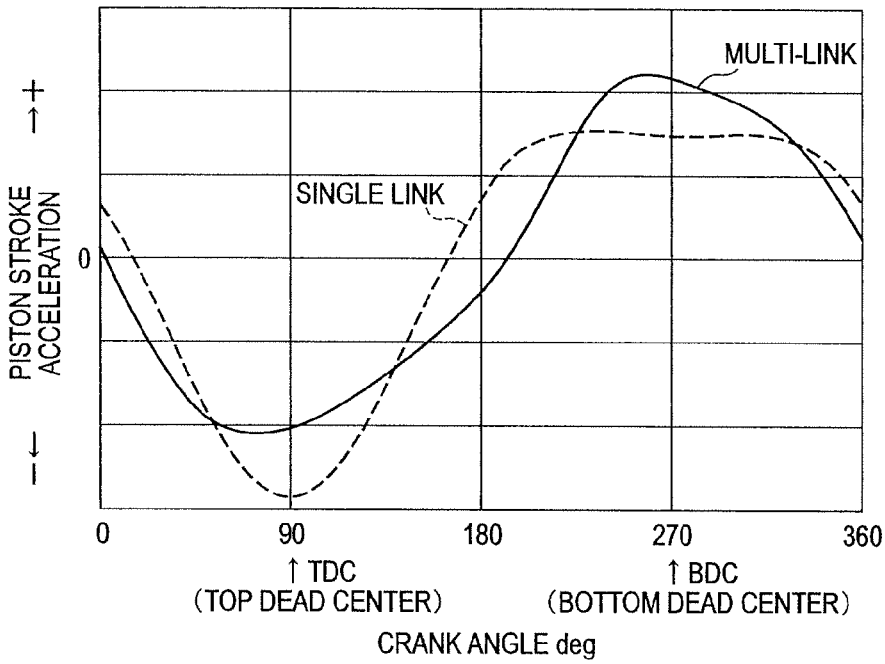
PRIOR ART FIG.8B
Figure 9:
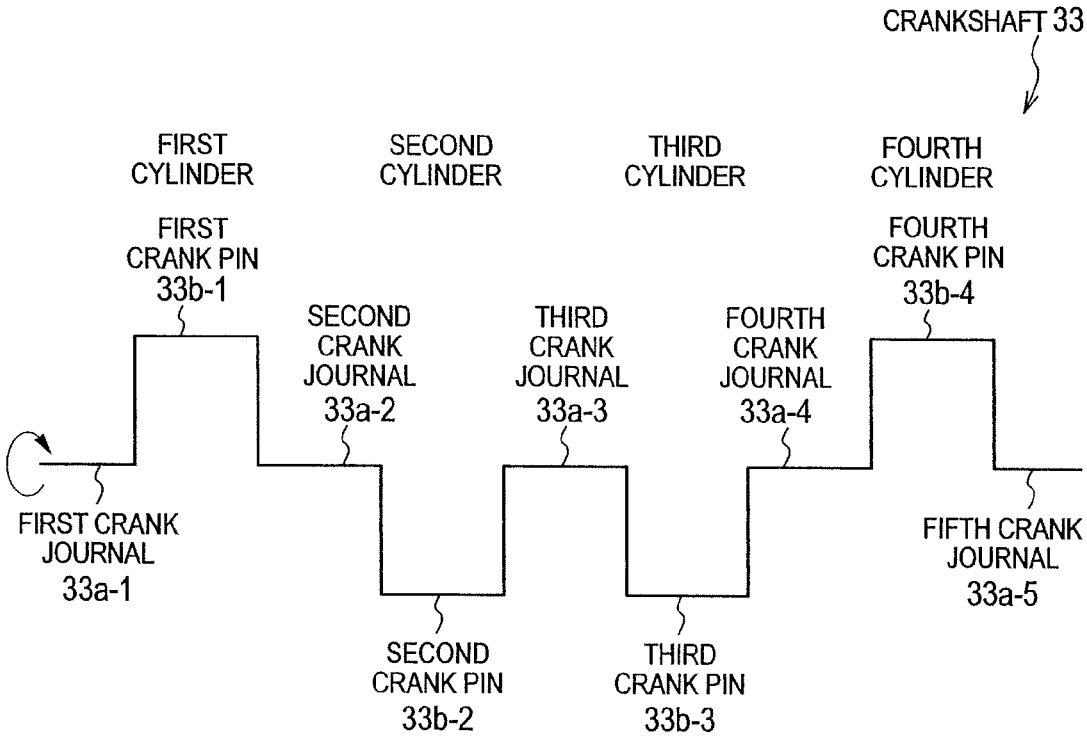
PRIOR ART FIG.9
FIG. 9 is a schematic constitutional diagram of a crankshaft in a conventional serial four-cylinder engine.

Further, at piston top dead center, $R_3$ and $R_6$ shown in FIG. 7 are expressed by the following Equations (7-1) and (7-2).

$$R_3=L_2 \sin\theta_2 \tag{7-1}$$

$$R_6=L_4 \sin\theta_4 \tag{7-2}$$

where:

$\theta_2$ is an angle subtended by the control link 13 and a line segment linking the crank pin 33*b* and the control pin 23; and $\theta_4$ is an angle subtended by the upper link 11 and a line segment linking the crank pin 33*b* and the upper pin 22.

The following Equation (8) is then preferably established.

$$\sin\theta_4<\sin\theta_2 \tag{8}$$

In so doing, $R_6$ can be reduced to a minimum, and as a result, the load can also be suppressed at top dead center.

Although the invention has been described above by reference to certain embodiments of the invention, the invention is not limited to the embodiments described above. Modifications and variations of the embodiments described above will occur to those skilled in the art, within the scope of the claims.

The contents of Tokugan 2007-210803 with a filing date of Aug. 13, 2007 in Japan are hereby incorporated by reference.

The embodiments of this invention in which an exclusive property or privilege is claimed are defined as follows:

What is claimed is:

1. An internal combustion engine, comprising:

an upper link connected via a piston pin to a piston that reciprocates within a cylinder;

a lower link attached to a crank pin of a crankshaft to be free to rotate and connected to the upper link via an upper pin; and a control link which is connected to the lower link via a control pin and oscillates about an oscillation central shaft, wherein a following equation is established when the piston is at bottom dead center $$\cos(\theta_l+\alpha)<\cos(\theta_l+\pi)$$

where:

$\theta_l$ is a lower link attitude angle formed by a line connecting the control pin and the crank pin and a line perpendicular to the upper link and passing through the crank pin; and $\alpha$ is a lower link aperture angle formed by the line connecting the control pin and the crank pin and a line connecting the crank pin and the upper pin.

2. The internal combustion engine as defined in claim 1, wherein the lower link aperture angle $\alpha$ is smaller than $\pi$.

3. The internal combustion engine as defined in claim 1, wherein a direction in which a line segment linking any two points on a moving locus of the upper pin has a maximum length matches a piston stroke direction.

4. The internal combustion engine as defined in claim 1, wherein, when an axis that has a crank journal of the crankshaft as an origin, is parallel to the piston stroke direction, and has an engine upper portion direction as a positive is set as a Y axis, and an axis rotated −90° relative to the Y axis in a crank rotation direction is set as an X axis, the oscillation central shaft is disposed in a region of a third quadrant (X<0 and Y<0).

5. The internal combustion engine as defined in claim 1, wherein, when the piston is at bottom dead center, a following equation is established $$\cos(\theta_l + \alpha) > \frac{R_0 + D_4}{L_4}$$

where:

$R_0$ is a rotation radius of the crank pin;

$D_4$ is a value of half a width of the upper pin; and $L_4$ is an inter-axial distance from the crank pin to the upper pin.

6. The internal combustion engine as defined in claim 1, wherein, when the piston is at bottom dead center, a lower end of a skirt of the piston is positioned below a lower end of a cylinder bore.

7. The internal combustion engine as defined in claim 1, wherein, when the piston is at top dead center, a following equation is established $$\sin \theta_4 < \sin \theta_2$$

where:

$\theta_2$ is an angle subtended by the control link and a line segment linking the crank pin and the control pin; and $\theta_4$ is an angle subtended by the upper link and a line segment linking the crank pin and the upper pin.

8. An internal combustion engine, comprising:

an upper link connected via a piston pin to a piston that reciprocates within a cylinder;

a lower link attached to a crank pin of a crankshaft to be free to rotate and connected to the upper link via an upper pin; and a control link which is connected to the lower link via a control pin and oscillates about an oscillation central shaft, wherein, at a timing when a piston acceleration reaches a maximum, a following equation is established $$\cos(\theta_l+\alpha) < \cos(\theta_l+\pi)$$

where:

$\theta_l$ is a lower link attitude angle formed by a line connecting the control pin and the crank pin and a line perpendicular to the upper link and passing through the crank pin; and $\alpha$ is a lower link aperture angle formed by the line connecting the control pin and the crank pin and a line connecting the crank pin and the upper pin.

9. The internal combustion engine as defined in claim 8, wherein, when the piston is at top dead center, a following equation is established $$\sin \theta_4 < \sin \theta_2$$

where:

$\theta_2$ is an angle subtended by the control link and a line segment linking the crank pin and the control pin; and $\theta_4$ is an angle subtended by the upper link and a line segment linking the crank pin and the upper pin.

* * * * *